US007567210B2

(12) United States Patent
Wu

(10) Patent No.: US 7,567,210 B2
(45) Date of Patent: Jul. 28, 2009

(54) SMALL SIZE ULTRA-WIDEBAND ANTENNA

(75) Inventor: Chun-Yi Wu, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 212 days.

(21) Appl. No.: 11/258,805

(22) Filed: Oct. 26, 2005

(65) Prior Publication Data

US 2007/0069959 A1 Mar. 29, 2007

(30) Foreign Application Priority Data

Sep. 23, 2005 (TW) ..... 94133194 A

(51) Int. Cl.
*H01Q 1/38* (2006.01)

(52) U.S. Cl. ..... 343/700 MS; 343/702

(58) Field of Classification Search ..... 343/700 MS, 343/846, 848, 702
See application file for complete search history.

(56) References Cited

U.S. PATENT DOCUMENTS 6,639,560 B1 * 10/2003 Kadambi et al. ..... 343/700 MS
6,720,925 B2 * 4/2004 Wong et al. ..... 343/700 MS
6,985,112 B2 * 1/2006 Sadamori et al. ..... 343/702
7,046,197 B2 * 5/2006 Okado ..... 343/700 MS
2002/0080078 A1 * 6/2002 Trumbull et al. ..... 343/702
2003/0132882 A1 * 7/2003 Wong et al. ..... 343/700 MS
2003/0146878 A1 * 8/2003 Mikkola et al. ..... 343/702
2005/0030230 A1 * 2/2005 Otaka et al. ..... 343/700 MS
2005/0052322 A1 3/2005 Park et al. ..... 343/700
2005/0099344 A1 * 5/2005 Okubo et al. ..... 343/702
2005/0134460 A1 * 6/2005 Usami ..... 340/572.7
2006/0187121 A1 * 8/2006 Chang et al. ..... 343/700 MS
2007/0013589 A1 * 1/2007 Park et al. ..... 343/702

OTHER PUBLICATIONS

Novel Anennas for Ultra-Wideband Communications N. Fortino, G. Kossiavas, J. Y. Dauvignac, and R. Staraj Microwave and Optical Technology Letters/vol. 41, No. 3, May 5, 2004.

* cited by examiner

*Primary Examiner*—HoangAnh T Le

(57) ABSTRACT

A small size ultra-wideband (UWB) antenna comprises a radiation element, a dielectric substrate, and a dielectric element. The radiation element includes a radiation conductor, a matching element, and an antenna feeding element. A signal feeding element and a conductor plane are formed on the upper and lower surfaces of the dielectric substrate, respectively. With the matching element on the radiation conductor, the current distribution on the conductor plane is changed so that the antenna achieves a sufficient extension for both high and low impedance bandwidths. The UWB antenna is also suitable for surface-mountable fabrication process, which effectively reduces the manufacturing cost. The antenna has the advantages of small size, simple structure, and an impedance bandwidth of 7.97 GHz.

13 Claims, 9 Drawing Sheets

SMALL SIZE ULTRA-WIDEBAND ANTENNA

FIELD OF THE INVENTION

The present invention generally relates to an antenna, and more specifically to a small size ultra-wideband antenna.

BACKGROUND OF THE INVENTION

In general, an ultra-wideband (UWB) antenna refers to a communication system with its fractional bandwidth larger than 25%, or greater than 1.5 GHz. Since an UWB antenna technology involves carrier-free, low power consumption and high-frequency digital pulses for data transmission, the required transmission bandwidth tends to be pretty large. The current UWB technology is mainly used for public safety and broadband wireless communications. In United States, as of February 2002, the Federal Communications Commission (FCC) has released UWB for equipments, such as ground penetrating radar systems, through wall imaging systems, and medical imaging systems for the purpose of public safety utilizations. For broadband wireless indoor communications, FCC also approved the frequency range of 3.1-10.6 GHz for UWB communication and measurement systems. The Taiwan Telecommunication has also included this spectrum of frequencies for the future utilization plan.

In the teams of academics and industries, researches on the UWB antenna are mostly based on wideband matching, or multiple-resonance-path perspectives. In terms of packaging types, UWB antennas are mostly in shape of monopole or dipole variations.

U.S. patent publication 2005/005,232,2A1 disclosed an antenna suitable for UWB communication systems. Referring to FIG. 1, a patch radiation element 101 that is smaller than a dielectric substrate 108, is formed on the surface of the substrate 108. The radiation energy of the patch radiation element 101 is activated by the current fed via the feeding line 103. Wherein, the bandwidth of the antenna is controlled by air gap slot 102 formed within the patch radiation element 101. To accomplish the impedance matching between the radiation element 101 and the feeding line 103, there are matching elements 104 and 105 formed between the radiation element 101 and the feeding line 103.

Compared with an ordinary monopole antenna, this type of antenna design advantages itself as providing broad enough impedance bandwidth, which can meet the general need for UWB applications. This type of antenna, however, has a high profile of 30×35 $mm^2$ in dimension, which is hard to be applied to small size personal communication equipments, such as mobile phones, personal digital assistants, etc.

SUMMARY OF THE INVENTION

To overcome the drawbacks of the conventional UWB antenna design with high profile, the present invention provides a small size UWB antenna.

The small size UWB antenna design comprises one radiation element, one dielectric substrate, and one dielectric element. Wherein, the radiation element comprises one radiation conductor, one matching element, and one antenna feeding element. A signal feeding element and a conductor plane are formed on the upper and lower surfaces of the dielectric substrate, respectively. The signal feeding element electrically connects to both the conductor plane and the antenna feeding element, respectively. The dielectric element is used for supporting the radiation element.

The signal feeding element can be made of a coaxial transmission line or a microstrip transmission line. The design for the matching element can vary. Examples include one or more air gap slots, one or more electrical connection points, one or more electrical coupling points, etc. The location of the radiation element can also vary. For instance, the radiation element can be on the side part on the dielectric substrate, be coplanar with the dielectric substrate, be on the upper part of the dielectric substrate, etc. The antenna feeding element may have varieties of design such as having the feeding end and the side end press-fit on the surface of the dielectric substrate and forms a surface-mountable chip antenna. The previously mentioned variations are illustrated and described in detail with the following embodiments of the present invention.

According to the present invention, with the matching element on the radiation conductor, the current distribution on the conductor plane is changed in such a way that the whole antenna achieves a sufficient extension for both high and low impedance bandwidths. The small size UWB antenna according to the present invention is also suitable for surface-mountable fabrication process, and thus effectively reduces the overall manufacturing cost.

The result from the simulated experiments shows that the antenna of the present invention can achieve a high impedance bandwidth up to 7.97 GHz. The preferred profile of the antenna dimension ranges from 6-16 mm for the length and 5-14 mm for the width. The preferred profile of the matching element dimension ranges from 1-5 mm for the length and 0.5-1.5 mm for the width.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
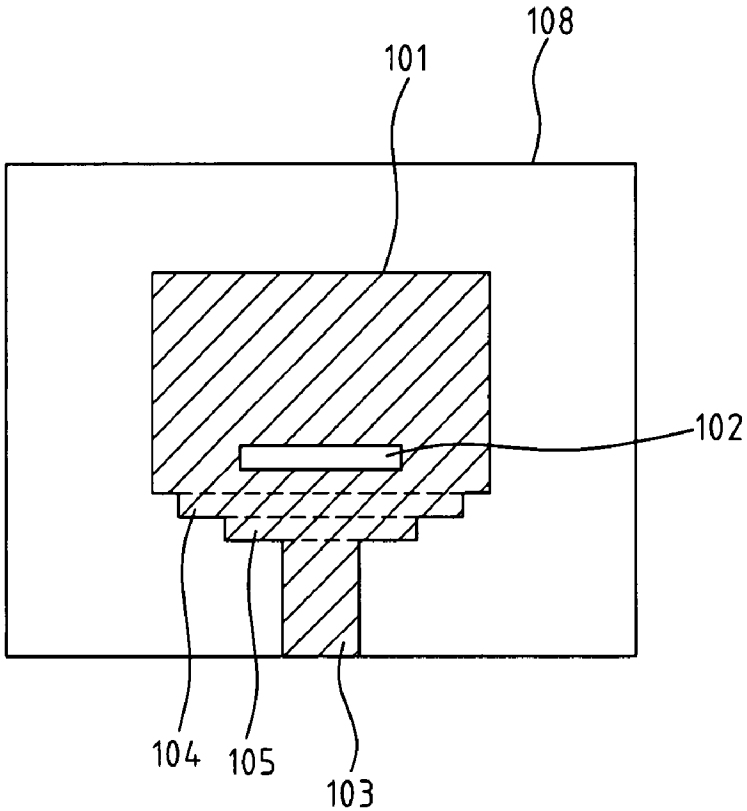
FIG. 1 (PRIOR ART)
FIG. 1 shows a front side view of a traditional UWB antenna.
Figure 2:
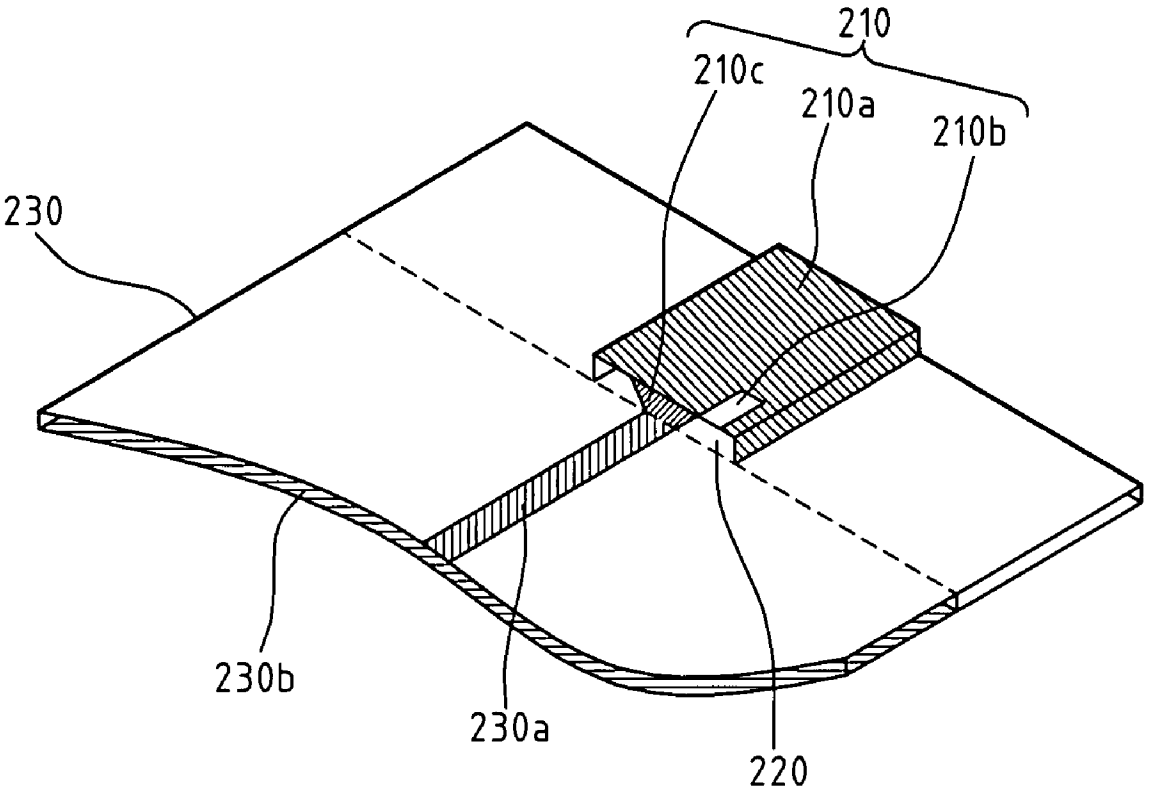
FIG. 2 shows a structural view of a small size UWB antenna according to the present invention.

FIG. 2 shows a structural view of a small size UWB antenna according to the present invention. Referring to FIG. 2, the small size UWB antenna comprises one radiation element 210, one dielectric substrate 230, and one dielectric element 220. The radiation element 210 comprises one radiation conductor 210*a*, one matching element 210*b*, and one antenna feeding element 210*c*. The matching element 210*b* changes the current distribution on the radiation conductor 210*a*, in such a way that both the high and low impedance bandwidths can be sufficiently extended. There are one signal feeding element 230*a* and one conductor plane 230*b* formed on the upper and lower surfaces of the dielectric substrate 230, respectively. The signal feeding element 230*a* electrically connects to the antenna feeding element 210*c* and the radiation frequency feeding source, respectively. The dielectric element 220 is for carrying the radiation element 210.

With the matching element on the antenna according to the present invention, the current distribution on the surface of the radiation conductor can be altered to achieve a very broadband impedance matching in both high and low extensions. The impedance bandwidth can also be slightly tuned up by changing the location of the radiation element. The location of the radiation element is not limited to being along the center line on the dielectric substrate surface.

According to the present invention, the design for the radiation element can also vary by altering the locations of the radiation element 210, the matching element 210*b*, and the antenna feeding element 210*c*.

The design for the signal feeding element 230*a* can also vary by using a coaxial transmission line or a microstrip transmission line. The electrical connection type can also contribute into the design variations. In the following embodiments of the present invention, some examples are shown for the detailed description of the design variations.

Figure 3:
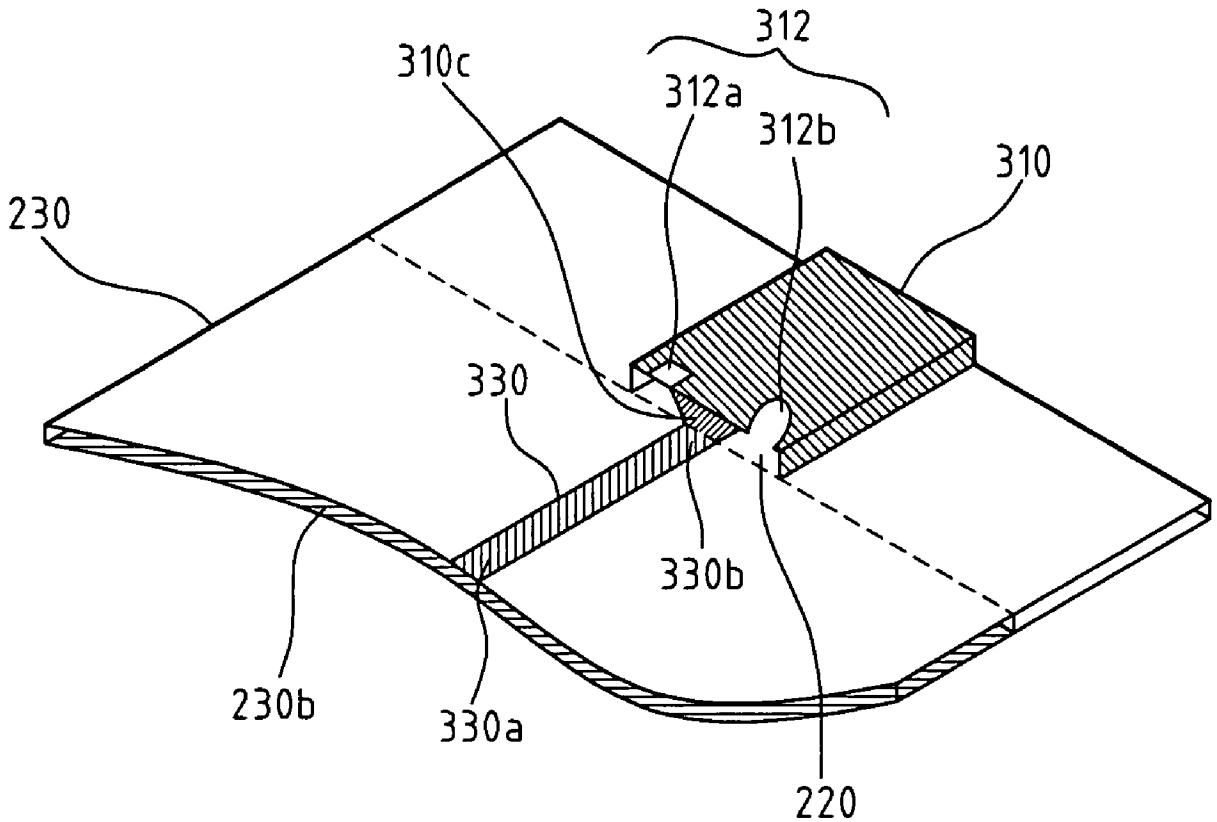
FIG. 3 shows a structural view of a first embodiment of the present invention.

FIG. 3 illustrates a first embodiment of the present invention, wherein the radiation element 310 is located at the upper part on the surface of the dielectric substrate 230. With a conductor press-fit technique, the antenna feeding element 310*c* is press-fit onto the surface of the dielectric substrate 230 and forms a surface-mountable chip antenna. The matching element 312 includes one or more air gap slots. An air gap slot can have varieties of shapes. Without losing the generality, in this embodiment, the matching element 312 includes one polygon shaped slot 312*a* and one ellipse shaped slot 312*b*.

In this embodiment, the signal feeding element is a microstrip transmission line 330 on the surface of the dielectric substrate 230. The two ends 330*a* and 330*b* of the microstrip transmission line 330, electrically connect to the radiation signal feeding source and the antenna feeding element 310*c*, respectively, so that the antenna operation mode can be activated.

The location of the radiation element can vary. Other than at the upper center part of the dielectric substrate surface, the radiation element can also be located on the side part on the dielectric substrate surface, or be press-fit on the dielectric substrate surface, or even located outside of the dielectric substrate.

The design for the matching element can vary too. The variation includes one or more air gap slots, one or more electrical connection points, one or more electrical coupling points, etc. Without losing the generality, the following embodiments of the present invention illustrate the design variations.

Figure 4:
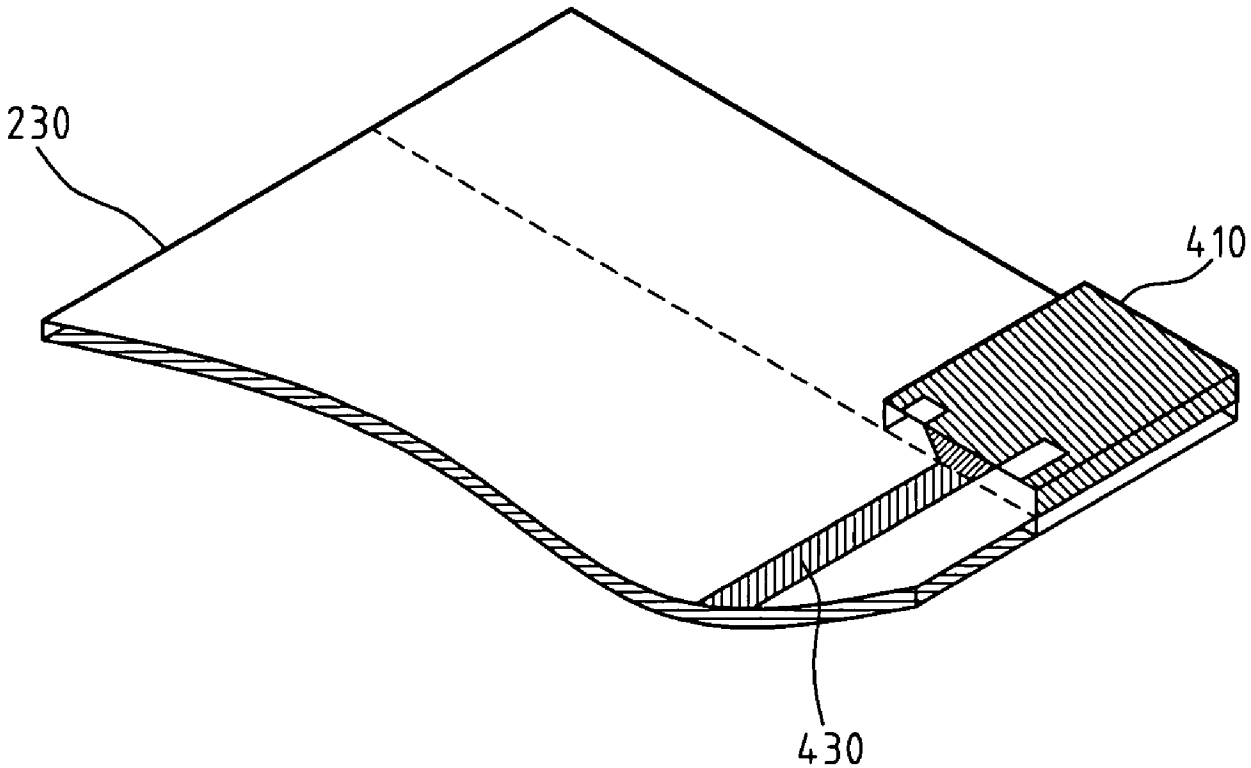
FIG. 4 shows another example illustrating the radiation element located at a different position on the dielectric substrate according to the present invention.

In FIG. 4, the radiation element 410 is located at the side part on the dielectric substrate 230 surface. The position of the electrically connected transmission line 430 also is at the side part on the dielectric substrate 230 surface.

Figure 5:
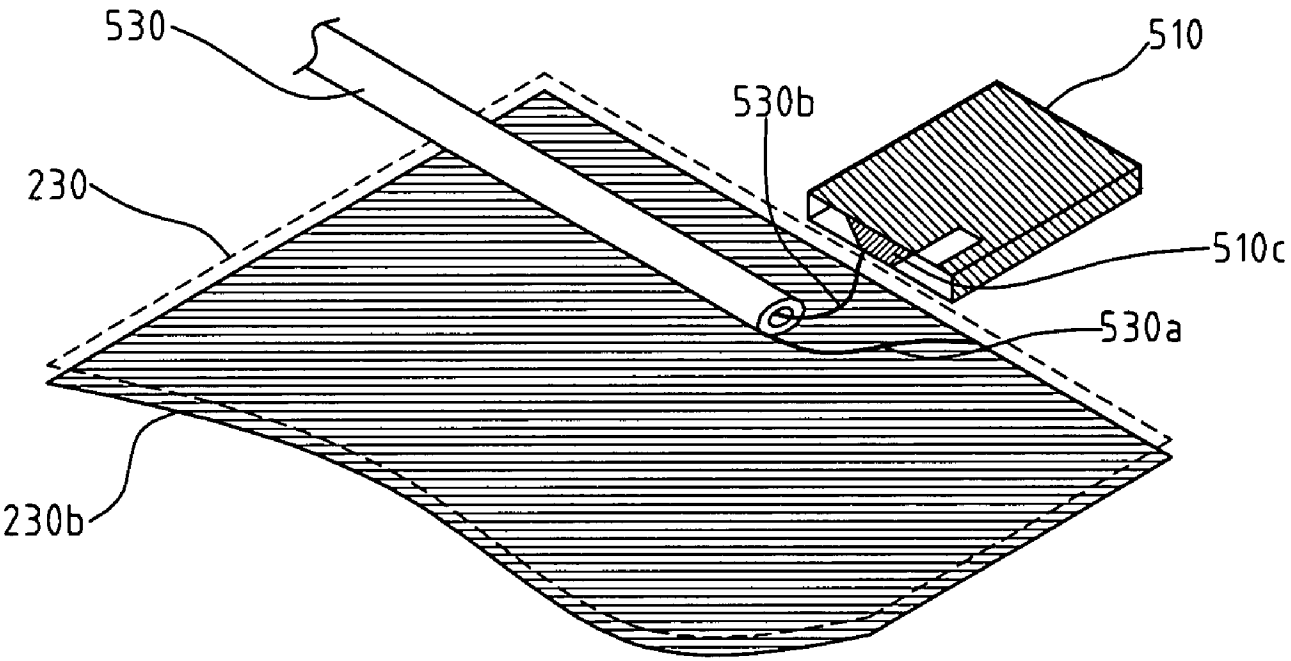
FIG. 5 shows an example illustrating another variation of the signal feeding element and the different location of the radiation element according to the present invention.

FIG. 5 illustrates another example of the present invention as a variation of the signal feeding element and the different location for the radiation element. Referring to FIG. 5, the radiation element 510 is located outside of the dielectric substrate 230. In this embodiment, the signal feeding element is a coaxial transmission line 530. The two ends 530*a* and 530*b* of the coaxial transmission line 530 electrically connect to the conductor plane 230*b* and the antenna feeding element 510*c*, respectively. This thus activates the whole antenna operation mode.

Figure 6:
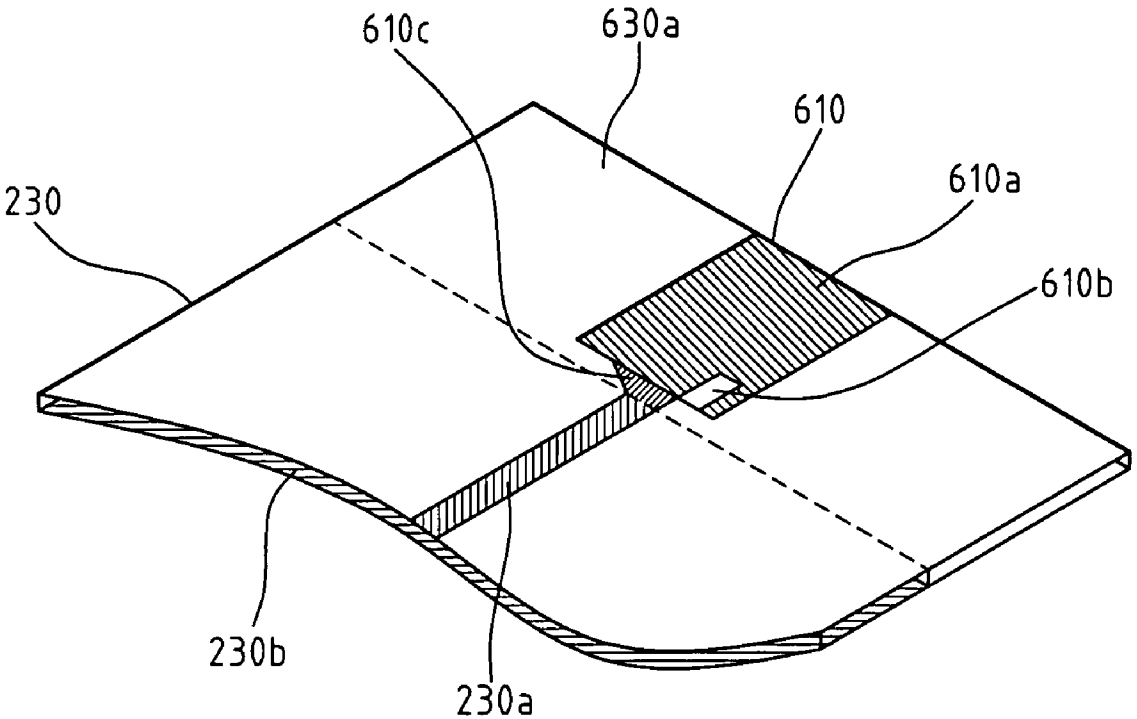
FIG. 6 shows another design variation of the radiation element according to the present invention.

FIG. 6 illustrates another embodiment as a variation of the radiation element with the present invention. Referring to FIG. 6, the radiation element 610 is press-fit on the upper surface 630*a* of the dielectric substrate 230. The radiation conductor 610*a*, the matching element 610*b*, and the antenna feeding element 610*c* are all coplanar with the upper surface 630*a*.

Figure 7:
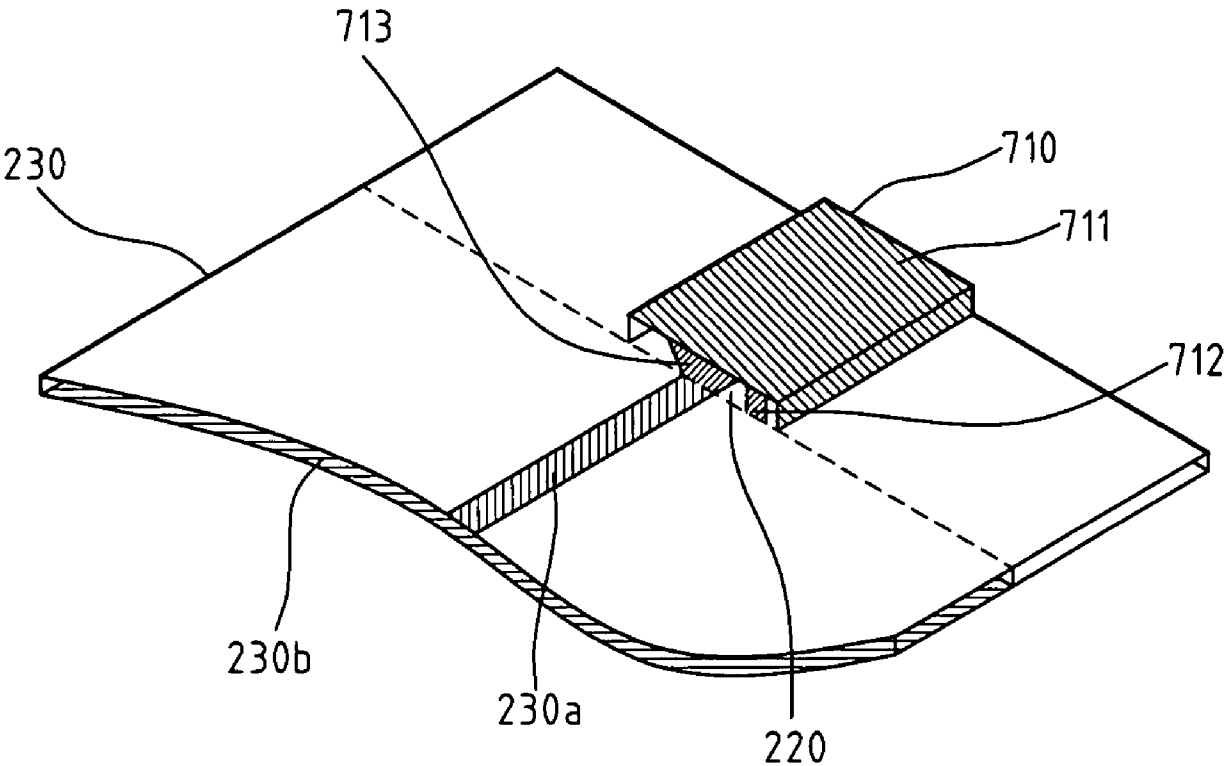
FIG. 7 shows a variation of the matching element according to the present invention, which has an electrical connection point.

FIG. 7 illustrates an embodiment of a matching element with one electrical connection point. Without losing the generality, this invention uses this embodiment with one electrical connection point for explanation purposes. Referring to FIG. 7, the radiation element 710 comprises one radiation conductor 711, one matching element 712, and one antenna feeding element 713, wherein, the matching element 712 is an electrical connection point.

Figure 8:
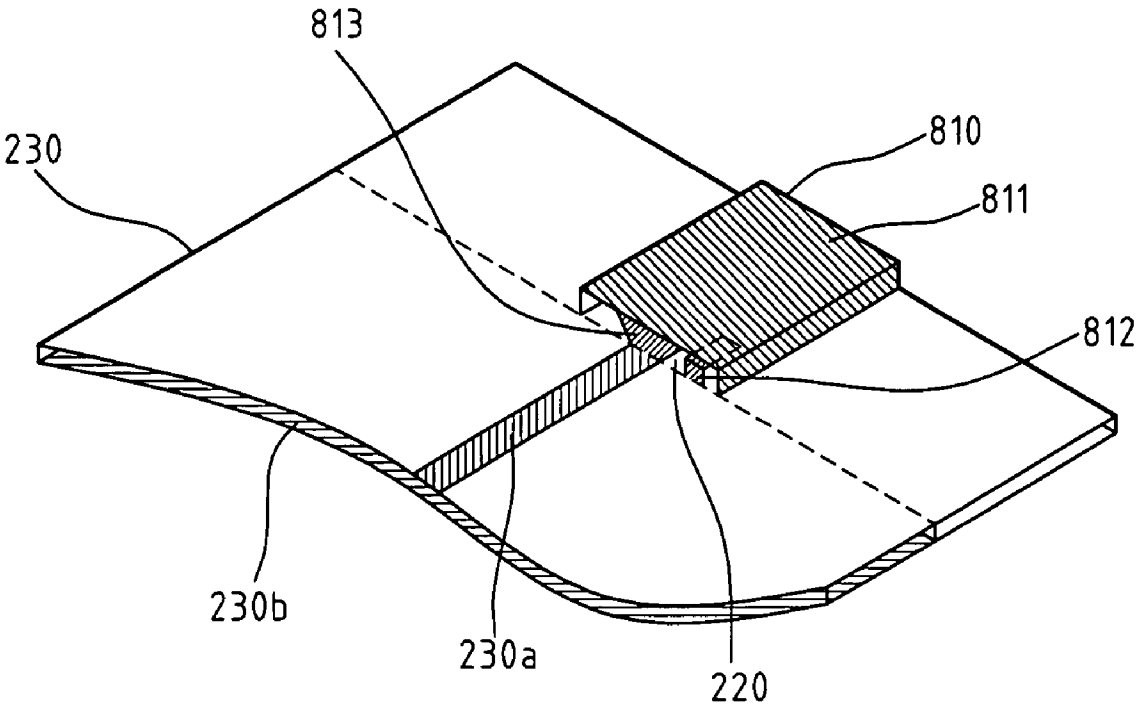
FIG. 8 shows a variation of the matching element according to the present invention, which has an electrical coupling point.

FIG. 8 illustrates an embodiment of a matching element with one electrical coupling point. Without losing the generality, this invention uses this embodiment with one electrical coupling point for explanation purposes. Referring to FIG. 8, the radiation element 810 comprises one radiation conductor 811, one matching element 812, and one antenna feeding element 813, wherein, the matching element 812 is an electrical coupling point.

Figure 9:
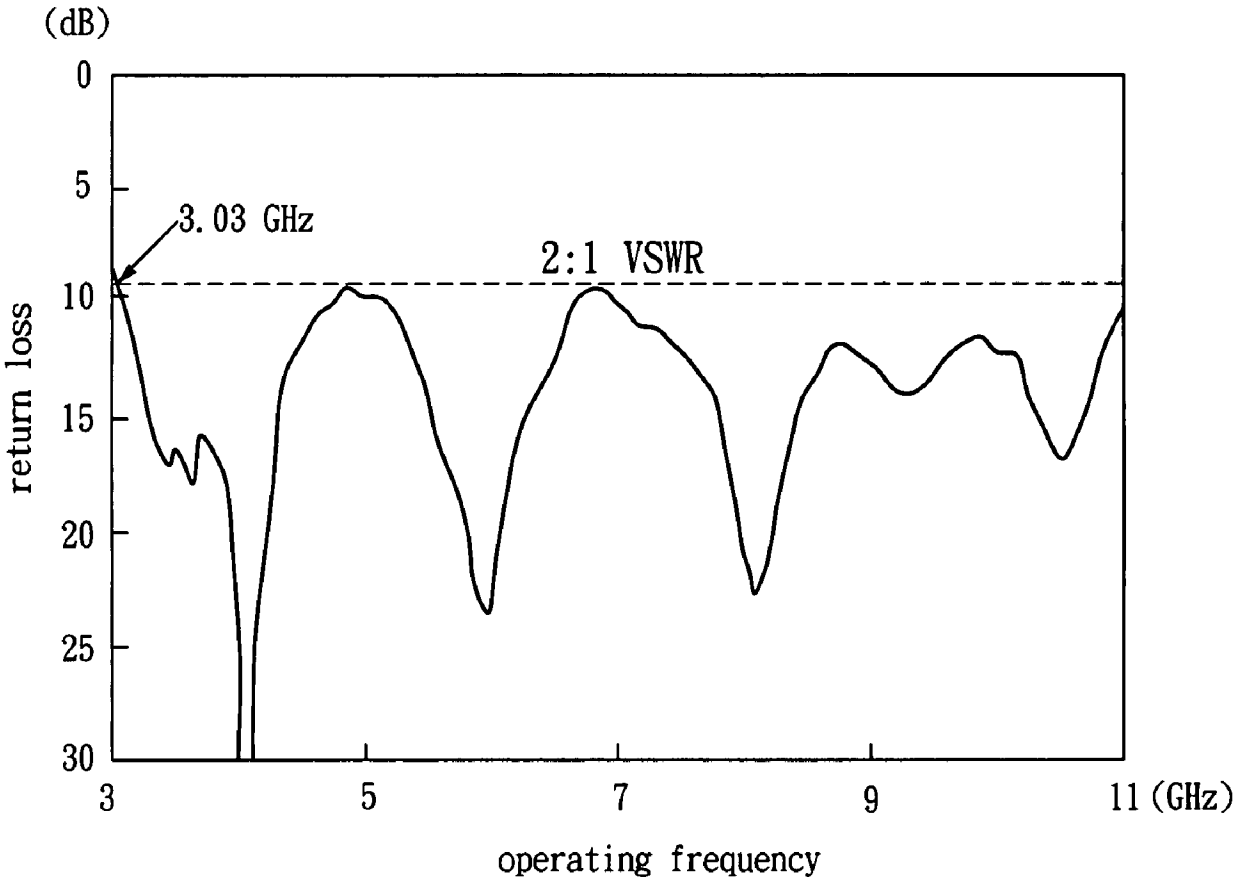
FIG. 9 shows the measured result of the characteristic return loss from the embodiments of the present invention.

FIG. 9 illustrates the characteristic measurement result for the antenna return loss from the embodiment of the present invention. Wherein, the horizontal axis represents the antenna operating frequencies (in unit of GHz); while the vertical axis represents the antenna return loss (in unit of dB). With the voltage standing wave ratio (VSWR) of 2:1 as definition, the impedance bandwidth shown in the measurement plotting is 7.97 GHz, which is 3.03-11.0 GHz, as shown in FIG. 9.

In conclusion, the present invention provides a small size UWB antenna, wherein, with the matching element on the radiation conductor plane, the current distribution on the conductor plane can be changed, so that both high and low impedance bandwidths can be sufficiently extended. The impedance bandwidth can be extended up to 7.97 GHz. The present invention also advantages itself as a design with small size, simple structure, and easy fabrication. With the conductor press-fit technique, the small size UWB antenna according to the present invention can be press-fit onto a surface-mountable ship antenna, which qualifies itself as a design with low manufacturing cost and high yield of application production benefits.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A small size Ultra-Wideband (UWB) antenna, comprising:

a radiation element including one radiation conductor, one matching element and one antenna feeding element, and said matching element having length between 1 to 5 mm and width between 0.5 to 1.5 mm for changing current distribution of said radiation conductor to provide impedance matching for a high frequency band including operating frequency at 7.97 GHz;

a dielectric substrate, upper and lower surfaces of said dielectric substrate having one signal feeding element and one conductor plane thereon, respectively, and said signal feeding element connecting electrically to said antenna feeding element; and a dielectric element carrying said radiation element;

wherein said antenna feeding element is connected to an edge of said radiation conductor and said matching element extends from said edge into said radiation conductor immediately adjacent to said antenna feeding element.

2. The small size UWB antenna as claimed in claim 1, wherein said matching element includes one or more air gap slots.

3. The small size UWB antenna as claimed in claim 1, wherein said matching element includes one or more electrical connection points.

4. The small size UWB antenna as claimed in claim 1, wherein said matching element includes one or more electrical coupling points.

5. The small size UWB antenna as claimed in claim 1, wherein said signal feeding element is a coaxial transmission line.

6. The small size UWB antenna as claimed in claim 1, wherein said signal feeding element is a microstrip transmission line.

7. The small size UWB antenna as claimed in claim 1, wherein said radiation element is located at a side part on the upper surface of said dielectric substrate.

8. The small size UWB antenna as claimed in claim 1, wherein said radiation element is located at a center upper part on the upper surface of said dielectric substrate.

9. The small size UWB antenna as claimed in claim 1, wherein said radiation element and said upper surface of said dielectric substrate are coplanar.

10. The small size UWB antenna as claimed in claim 1, wherein said radiation element is located outside of said dielectric substrate.

11. The small size UWB antenna as claimed in claim 1, wherein said antenna is suitable for a surface-mountable chip antenna.

12. The small size UWB antenna as claimed in claim 1, wherein said matching element includes one polygon shaped slot.

13. The small size UWB antenna as claimed in claim 1, wherein said matching element includes one ellipse shaped slot.

* * * * *